United States Patent [19]

Snitgen

[11] 4,455,828

[45] Jun. 26, 1984

[54] HYDRAULIC POWER UNIT

[76] Inventor: Joseph D. Snitgen, 18828 Hillcrest, Birmingham, Mich. 48009

[21] Appl. No.: 307,232

[22] Filed: Sep. 30, 1981

[51] Int. Cl.[3] ..... B60T 13/00

[52] U.S. Cl. ..... 60/547.1; 60/567; 60/576; 60/581; 60/593

[58] Field of Search ..... 60/547.1, 560, 567, 60/571, 576, 579, 581, 593, 563, 564, 573, 574

[56] References Cited

U.S. PATENT DOCUMENTS

| | | | |
|---|---|---|---|
| 2,032,185 | 2/1936 | Sciaky | 60/567 |
| 3,001,369 | 9/1961 | Allais | 60/581 |
| 3,257,810 | 6/1966 | Hanni | 60/54.5 |
| 3,407,601 | 10/1968 | Beck | 60/54.5 |
| 3,513,656 | 5/1970 | Engle | 60/54.5 |
| 3,633,365 | 1/1972 | Belknap | 60/576 |
| 4,170,876 | 10/1979 | Dits et al. | 60/547 R |
| 4,241,581 | 12/1980 | Chace | 60/567 |

FOREIGN PATENT DOCUMENTS

| | | | |
|---|---|---|---|
| 2538870 | 4/1976 | Fed. Rep. of Germany . | |
| 939951 | 10/1963 | United Kingdom | 60/571 |

*Primary Examiner*—Abraham Hershkovitz

*Attorney, Agent, or Firm*—Harness, Dickey & Pierce

[57] ABSTRACT

A maximum displacement, reciprocating air operated demand only hydraulic power unit for supplying hydraulic fluid under pressure to one or more hydraulic motors, comprising a pneumatic power cylinder having a power piston therein, a hydraulic slave cylinder having a slave piston therein powered by said power piston, said slave cylinder being connected to each said hydraulic motor to power same, a valve mechanism for controlling the supply of air and oil to said power and slave cylinders, a mechanism to control the valve mechanism to operate the unit in a steady reciprocating motion, and an intensifier for two stage operation of said motors in either operating direction of the unit. An accumulator may also be included to supply fluid when the unit changes direction.

15 Claims, 2 Drawing Figures

HYDRAULIC POWER UNIT

BACKGROUND AND SUMMARY OF THE INVENTION

The present invention relates to hydraulic power supplies, and more particularly to air operated volumetric hydraulic power units ideally suited for powering high production multiple head welding machines and like equipment of the type disclosed in my co-pending application, Ser. No. 228,156, filed Jan. 23, 1981, which is a continuation-in-part of Ser. No. 120,112, filed Feb. 8, 1980, and now abandoned.

Machines using fluid motors (e.g., piston and cylinder assemblies) for clamping, actuating tools or welding guns, etc. are generally either pneumatically or hydraulically powered. If high speed is required air is often preferred because it is cleaner and will give faster action than oil at the same supply pressure; however, safety limits on usable pressures result in cylinder sizes which are too large for many applications. Oil can be used at higher pressures, thereby reducing cylinder sizes, but to get fast action relatively large displacement pumps are required. Hydraulic power units therefore tend to be large and costly, and because they have continuously operating pumps (even during the dwell or rest portion of the load cycle, because they must be able to quickly meet any sudden demand) they consume substantial amounts or power (variable displacement pumps may consume only moderate power, but are even more costly), are a source of continuous noise, and generate considerable heat because all excess is dumped back to the reservoir after being raised to working pressure.

It is therefore a primary object of this invention to provide an improved hydraulic power supply which operates on demancd only, i.e., it supplies oil under pressure only when required by the load, thereby virtually eliminating the consumption of power (and attendant operating cost), noise and heat build-up when the load is in the dwell or rest part of its cycle (often a substantial proportion of the total cycle time).

One limitation of the power unit disclosed in my prior co-pending application referenced above is that it is not adaptable for indexing. Thus the present invention has the object of providing an indexable demand hydraulic power unit, particularly for assembly plant operations where indexing is desired, but where speed of operation or high volume is not as important as indexing. Furthermore, the indexing will be provided without the need for an external signal, i.e., the unit will provide low or high pressure oil as required from the unit without presetting the unit for a time delay or due to a volumetric limitation. Also, the machine cycle can be commenced when the unit is at any point of its supply cycle, without any need to reset the unit.

The present invention offers the above features while also providing an intensifier for two stage operation of any hydraulic motors to be driven, in which the hydraulic motor initially advances toward the workpiece at a high rate of speed but with relatively little force, and upon engagement with the workpiece provides a very high force, but with limited displacement. No limit exists on the oil intensified as long as intensification is desired, unlike prior intensifing means which was limited by volmes in slave cylinders. The present invention provides all of the above features as a reciprocating unit in a steady reciprocating motion providing the above objects as the unit travels in either of its operating directions and without monitoring oil flow, and includes intensification in either operating direction of the unit (particularly advantageous if a working piston needs to be forcibly freed). It is desired to provide all of the above features with a unit having a gang of cylinders all of which are being powered in the same stroke rather than in sequence or separately, as done in the prior art. An optional accumulator is also disclosed to provide uniform oil pressure at the end of the stroke for smooth operation and oil supply at the end of the stroke.

Further objects of the present invention concern the provision of a demand type hydraulic power unit which can use less expensive fluids (95/5 oil) without fear of leakage, which is relatively compact and economical, which can provide desired high speeds without reliance on costly, bulk accumulators, and which can be retrofit to existing machines, including a reset of the working cylinders of the machines at the end of the machine operation.

Addtional advantages and features of the present invention will become apparent from the subsequent description and the appended claims, taken in conjunction with the accompanying drawing.

DETAILED DESCRIPTION OF THE PREFERRED EMBODIMENT

Figures 1, 2:
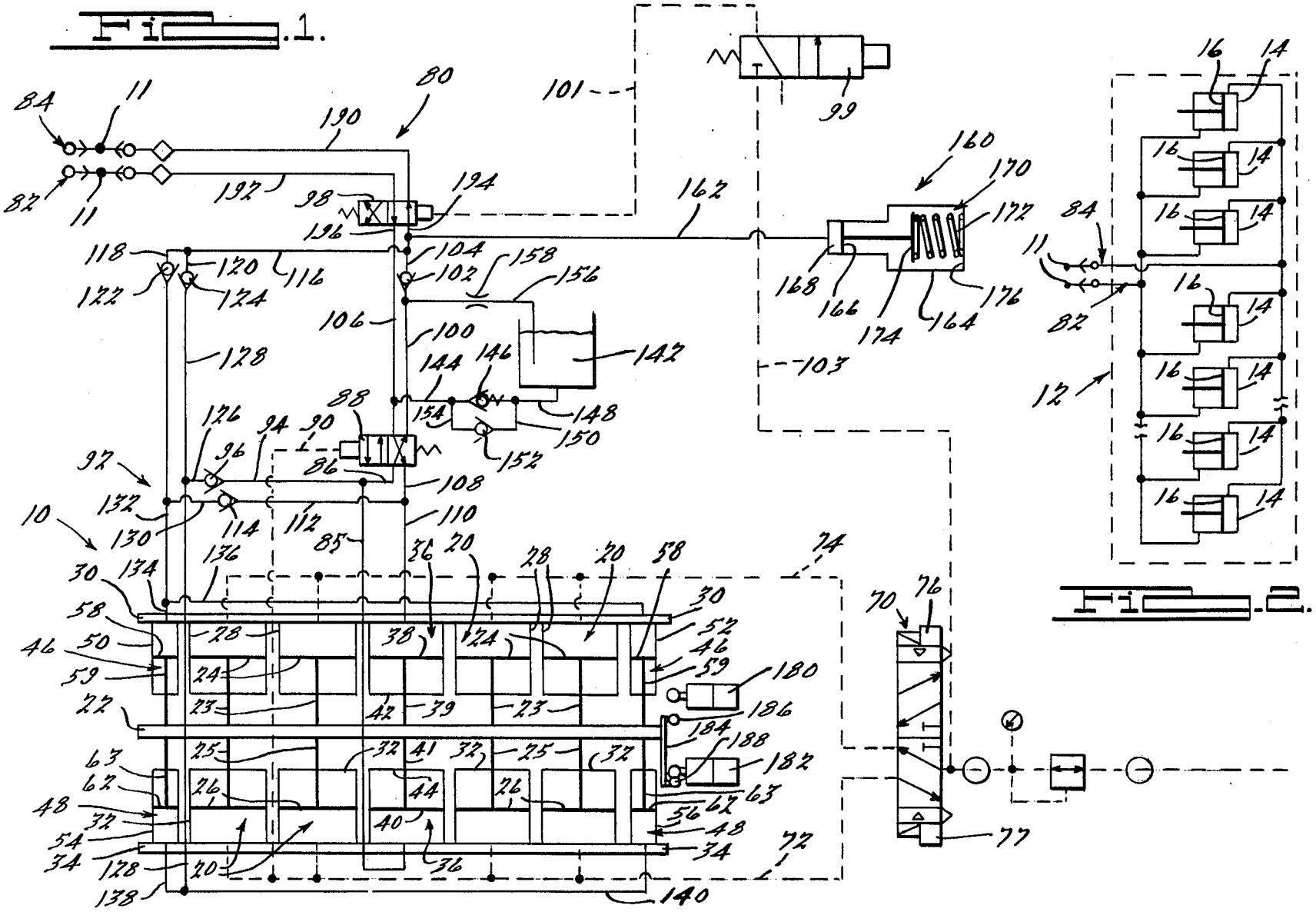
FIG. 1 is a schematic circuit diagram of an exemplary embodiment of the hydraulic power unit of the present invention. Oil conduits are shown as solid lines and air conduits are shown as broken lines.
FIG. 2 is a schematic circuit diagram of the driven machine operable to be associated with the hydraulic power unit of FIG. 1.

Generally speaking, the disclosed embodiment of the present invention comprises a hydraulic power unit 10 that drives a hydraulically operated machine 12, incorporating a plurality of working cylinders 14 each having a working piston 16 therein, a phantom line separating unit 10 from machine 12 in the drawing. Although machine 12 may be of any type requiring power in the form of a volume of oil under pressure, the present invention is particularly suited for use in powering multi-gun welding machines of the type used in the mass production of automobiles, appliances and the like. Each such machine may have dozens of separate guns, each requiring a separate working cylinder. If desired, suitable unions or couplings 11 may be provided between the power unit and the machine.

The power unit 10 comprises four master extensible fluid motors 20, as represented by pneumatic cylinders 20, interconnected at an axially intermediate point by a plate 22. Each cylinder 20 comprises an upper cylindrical air power transmitting member or piston 24 and a lower cylindrical air power transmitting member or piston 26 each fixedly secured to the plate 22 via rods 23 and 25 for pistons 24 and 26, respectively, or alternatively in some other direct manner. The four upper pistons 24 are each slidably secured within upper retract air housings 28 which in turn are fixedly connected onto upper plate 30. The four lower pistons 26 are each slidably secured within lower advance air housings 32 which are fixedly connected onto a lower plate 34.

A primary slave extensible fluid motor 36, as represented by hydraulic slave cylinder 36, having a cylindrical upper oil power transmitting member or piston 38 and a lower cylindrical oil power transmitting member or piston 40 fixedly secured to the intermediate plate 22 concentrically on opposite sides of the plate via rods 39 and 41 or some alternative direct manner, is disposed in a laterally intermediate location of the master extensible fluid motors or pneumatic cylinders 20. Upper piston 38 and lower piston 40 are slidably disposed in cylindrical housings 42 and 44, respectively, in a manner similar to the construction of the cylinders 20. Upper housing 42 is fixedly secured to upper plate 30 at the center of the plate 30 and lower housing 44 is similarly fixedly secured to lower plate 34.

Intensifier oil secondary slave fluid motors 46 and 48 are slideably disposed in cylindrical upper 50, 52 and lower 54, 56 housings in a manner identical to the construction of the primary slave fluid motor 36, except that the intensifier motors 46 and 48 have a much smaller bore than the priamry slave motor 36. Cylindrical upper housings 50 and 52 are fixedly mounted to stationary upper plate 30 and cylindrical lower housings 54 and 56 are fixedly mounted to lower plate 34. Each intensifier fluid motor 46 has a cylindrical upper oil power transmitting member or piston 58 fixedly secured to the intermediate plate 22 via rods 59. Likewise, each intensifier fluid motor 48 has a cylindrical lower oil power transmitting member or piston 62 fixedly secured to the intermediate plate 22 via rods 63. Thus, the intensifier fluid motors 46 and 48 are driven in parallel with and have the same stroke as both the master fluid motors 20 and the slave fluid motor 36.

The intermediate plate 22 has guide means (not shown) similar to that described in my above-referenced co-pending application, comprising eight apertures through the plate 22 through which rods are disposed, four rods located toward the interior of the plate 22 adjacent the hydraulic slave cylinder 36, and four rods disposed at the four corners of the plate 22 exteriorly of the pneumatic master cylinders 20. All eight rods are utilized to space apart and fixedly tie together upper plate 30 and lower plate 34. The four corner rods also function to guide the intermediate plate 22 in its upward and downward movements during the operation of the hydraulic power unit 10.

Thus the intermediate plate 22 moves upwardly and downwardly primarily in response to the movement of the four master cylinders 20, guided by the rods (not shown). The plate 22 then transmits movement to the hydraulic slave cylinder 36 and intensifier cylinders 46 and 48, whereby the slave cylinder 36 and intensifier cylinders 46 and 48 move as a gang in unison with the master air cylinders 20 disposed adjacent to them, all of the cylinders having the same stroke, but the intensifier cylinders 46 and 48 having a much smaller bore (approximatley 2½ inches each) than the bore of the slave cylinder 36 (approximately 6 inches).

Referring to FIG. 1, the power unit 10 of the present invention further comprises a primary dual solenoid operated air supply valve 70, including silencers (not shown), connected to the pneumatic master cylinders 20 by fluid conduits 72 and 74. The solenoid valve 70 is shown in a first position placing the upper pistons 24 of the master cylinders 20 in fluid communication with a presurized source of air (e.g., plant air) and the lower piston 26 of the cylinders 20 in fluid communication with the atmosphere, and is actuatable by the solenoids 76, 77 of the valve 70 to a second position to place the upper pistons 24 of the cylinders 20 in fluid communication with the atmosphere and the lower pistons 26 in fluid communication with the pressure source of air; and hydraulic slave cylinder 36 being connected via a fluid conduit system 80 to both a return or retract oil conduit system 82 (communicating with the rod end of each of the working cylinders 14) and to an advance oil conduit system 84 (communicating with the head end of each of the working cylinders 14). The lower housing 44 of the hydraulic slave cylinder 36 is connected via fluid conduits 85 and 86 to a pneumatically-operated, spring biased hydraulic four-way valve 88, which valve is connected via conduit 90 to air conduit 72. Conduit 85 also communicates with the oil intensifier system 92 via conduit 94 and check valve 96, as will be described later. In the position shown, the valve 88 communicates the lower housing 44 via conduits 85 and 86 with a second pneumatically-operated hydraulic four-way valve 98 via conduit 100, check valve 102 (spring biased to close), and conduit 104, with which the valve 98 communicates the advance oil conduit system 84. The same valve 98 communicates the retract or return oil conduit system 82 with valve 88 via conduit 106. Valve 98 is controlled by a solenoid operated three-way valve 99 communicating with valve 98 via conduit 101 and with a pressurized source of air via conduit 103.

In the position shown, valve 88 communicates with both the upper housing 42 of the hydraulic slave cylinder 36 via conduits 108 and 110 and with the oil intensifier system 92 via conduits 108 and 112 and check valve 114. The oil intensifier system 92 also communicates with conduit 104 above check valve 102 via conduits 116, 118, and 120 and check valves 122 and 124.

The intensifier system 92 communicate with fluid motors 46 and 48. Oil enters the intensifier system 92 via check valve 96 and conduit 126 into conduit 128 or via check valve 114 via conduit 130 into conduit 132. Oil exits the intensifier system via conduit 132 through check valve 122 or via conduit 128 through check valve 124, both of which communicate with conduit 104 above check valve 102. The upper portions 58 and 60 of the intensifier fluid motors 46 and 48 communicate with conduit 132 via conduits 134 and 136, respectively. The lower portions 62 and 64 of the intensifier fluid motors 46 and 48 communicate with conduit 128 via conduits 138 and 140, respectively.

To keep the lines full of hydraulic fluid a reservoir 142 is included with which conduit 106 communicates via conduit 144, a cracking check valve 146 (with a cracking pressure of 30 p.s.i.) and conduit 148. The reservoir in turn communicates with conduit 106 to fill the lines via conduit 148, by-pass conduit 150, swinging check valve 152, conduit 154, and conduit 144. A conduit 156 also bleeds into the resevoir 142 from conduit 100 below check valve 102 through a fixed orifice 158.

An accumulator 160 communicates with conduit 104 above check valve 102 and below valve 98 via conduit 162. The accumulator 160 comprises a housing 164, a piston 166 forming a chamber 168 in the housing 164, and a preload mechanism 170 (which in the illustrated embodiment is a heavy duty compression spring 172 acting against the opposite end 174 of piston 166 and seated against one wall 176 of housing 164).

The present invention uses one hydraulic four-way valve 98 to control the oil flow between the power unit 10 and the working cylinders 14. The second hydraulic four-way valve 88 is utilized to permit the power unit to be a reciprocating unit with all of the advantages of such an operation as have been detailed above. The position of the second valve 88 is controlled pneumatically in response to the position of the primary air control valve 70 (and whether or not pressurized air is being fed into conduit 72). The position of the primary dual solenoid air control valve 70 is set, in turn, by the output of an electrical circuit including limit switches 180 and 182 which alternately energize one or the other of the two solenoids 76, 77 associated with the air control vavle 70. The limit switches are mpounted in position adjacent the power unit 10, one switch 180 above the midpoint of travel of the intermediate plate 22 and the other switch 182 below the midpoint of travel of the plate 22. An actuation member 184 mounted on the plate 22 has two trip cams 186 and 188 directed outwardly from the plate 22 to trip each switch as the respective cam 186 or 188 passes the respective switch 180 or 182.

Thus, the present invention involves two systems, a control system to advance or retract the working cylinders 14 and a supply system to that control system, integrated to operate at all operating stages of the other system and also index as a two-stage intensifying mechanism (supplying high pressure oil) on demand regardless of the position of the supply system (supplying lower pressurized oil).

When it is desired to activate the hydraulic machine 12, electrical power is supplied to activate whichever solenoid 76 or 77 are in a position to be activated, based on the position of the intermediate plate 22. The three-way pneumatic solenoid valve 99 is activated to the ADVANCE position (as shown) which blocks the flow of pressurized air to valve 98. Valve 98 is positioned as shown to communicate conduit 104 with conduit 190 to supply low pressurized oil to the advance oil conduit system 84 and advance the working pistons 16 toward the workpiece. Valve 98 also communicates conduit 192 with conduit 106 to handle the return oil flow from the retract system 82 as the working pistons 16 lessen the displacement on the retract side of the working cylinders 14. It should be noted here that the port 194 at which conduit 104 interfaces valve 98 always has oil under pressure at that point. The port 196 at which conduit 106 interfaces valve 98 always has oil directed either to the reservoir 142 or to fill the slave cylinders 36, 46 or 48. The supply system will always provide pressurized oil to conduit 104 when it supplies pressurized oil and will receive oil from conduit 106 when it receives oil. Valve 88 performs the operation of supplying any pressurized oil to conduit 104(via conduit 100 and check valve 102) and supplying return oil from conduit 106 to the proper parts of the supply system.

Once the working pistons 16 have been advanced to a point that some resistance occurs againt further movement of the pistons 16 (such as contact with a workpiece) the oil in conduits 190 and 104 (through valve 98) will stall the unit 10 (having enough back pressure to close check valve 102) and force conduit 100 to bleed into reservoir 142 via conduit 156 and orifice 158. Oil under higher pressure will then be supplied from the intensifier system 92 via conduit 116. The supply line to conduit 116 will vary as either conduit 118 (up) or conduit 120 (down) depending upon whether the plate 22 is moving upwardly or downwardly.

A timer means, such as an automatically programmed timer (not shown) of the control panel of the machine 12, controlling the three-way valve 99 reverses the valve 99 to the retract position, shifting the piloted hydraulic valve 98 to the retract position (not shown) communicating port 194 of conduit 104 with retract conduit 192 (and opening check valve 102) and communicating port 196 of conduit 106 with advance conduit 190. The pressurized oil will retract the pistons 16 in cylinders 14 until a point where some resistance occurs against further movement of the pistons 16 (such as the end of the stroke or sticking of the piston in a position prior to the end of the stroke) where the unit 10 will stall (having enough back pressure to close check valve 102) and the intensifier system 92 will then supply higher pressure oil to further effect a complete return or retraction of the pistons 16 prior to the next operation of the unit 10. Again the high pressure oil will be supplied via conduit 116 and via conduits 118 (up) or 120 (down) depending upon whether the plate 22 is moving upwardly or downwardly.

As stated previously, the supply system always provides pressurized oil to conduit 100, check valve 102, conduit 104 and port 194 from slave cylinder 36 or the intensifier cylinders 46 and 48. This pressurized oil is supplied from either the upper 42, 50, 52 or lower 44, 54, 56 cylinder portions depending upon whether the late is traveling upwardly or downwardly as controlled by air valve 70. Thus, the intensifier cylinders 46 and 48 serve a dual purpose of supply low pressure oil to supplement slave cylinder 36 when in the portion of the cycle moving the cylinders toward (advance) or away from (retract) the workpiece and supplying higher pressure oil during the advance or retract intensifying portion of the cycle. The air valve 70 in turn is set to reverse the direction of the plate 22 and the stroke of the supply system as either trip cam 186 actuates limit switch 180 on its way up or trip cam 188 actuates limit switch 182 on its way down. It is noted here that any suitable limit switch mechanism may be used and the present invention is not limited to the mechanism disslosed and described herein.

The accumulator 160 is included to feed to port 194 supply pressurized oil for the tenth of a second that the unit needs to change direction of the stroke. The accumulator 160 will supply oil at whatever pressure the oil is being supplied, i.e. the accumulator 160 will supply oil whether the pistons 16 are advancing, retracting, or intensifying. Spring 172 provides a high preload, so that very little oil is accumulated (since very little is ever needed). The amount and pressure of the oil in chamber 168 depends on the pressure of the oil in conduit 104 with which the chamber 168 communicates via conduit 162. As the unit 10 changes stroke direction, the oil pressure in conduit 100 will lessen, check valve 102 will close, and accumulator 160 will provide oil to the pistons 16 for a short time (on the order of 0.2 second) until the pressure of the oil in conduits 100 or 116 has returned to its previous pressure level, providing smooth effective operation of the unit 10 in driving the machine 12. Thus, the accumulator 160 also works solely on demand at the point the stroke direction of the master cylinders 20 change.

It is also desirable to have the cylinders 20 furthest from the plate 22 dump as quickly as possible at the end of the stroke so that no exhaust occurs during the stroke and so that the unit may operate as quickly as possible. Thus, additional quick exhaust valves may be included in association with conduits 72 and 74 near the cylinders 20 actuated either by the output of one of the respective limit switches 180, 182, by the air pressure (or lack thereof) in the respective conduit 72, 74 (as a piloted valve), or by some other suitable sensing means.

To compensate for the differences in needed fluid levels between the advance and retract strokes of the working cylinders 14 (due to the rod displacing some volume on the retract stroke) and/or to compensate for any unavoidable leakage in the system, a reservoir 142 is included having a conduit-check valve system wherein conduit 106 communicates with the reservoir 142 via a return system comprising conduit 144, 30 p.s.i. cracking check valve 146, and conduit 148 and the reservoir, in return, communicates with conduit 106 via a supply system comprising conduits 148 and 150, check valve 152, and conduits 154 and 144. The reservoir 142 can be any size, and is preferably of large capacity so that it may communicate with more than one unit 10. The return system takes excess oil out of the system primary on the retract stroke of the pistons and cooperates with the supply system to equalize the oil level in the unit 10 and machine 12 at all times. The supply system replenishes oil due to leakage in all of the systems 36, 82, 84, and 92 since valve 88 communicates conduit 106 with each of those systems at one time or another during the operation of the unit 10 and machine 12.

The above described unit may be turned off when not in use or at rest unlike conventional hydraulic power units that still need approximately 90 per cent of the power required for operation while the unit is not in operation.

Thus, disclosed herein is a hydraulic power unit which is indexable without presetting the unit, giving low or high pressure oil as demanded by the machine or the unit, intensifying the advance or the retract stroke of the working pistons 16 in either direction of stroke movement of the unit 10, with no limit on the amount of oil intensified as long as the resistance or back pressure exists within the system as demanded. Less air is also needed per oil pumped in the above described unit over the unit described in my co-pending application since the air is used for a full stroke to power the cylinders 14 in both directions. Intensification provided by the unit 10 described herein also involves force multiplication at a lower rate than the unit described in my co-pending application.

Thus, there is disclosed in the above description and in the drawings an improved hydraulic power unit which fully and effectively accomplishes the objectives thereof. Any dimensions and sequence times set forth in the above specification are merely representative and are not meant to be limiting on the scope of the invention. It will be apparent that variations and modifications of the dislcosed embodiments may be made without departing from the principles of the invention or the scope of the appended claims.

I claim:

1. An air operated demand only hydraulic power unit for supplying hydraulic fluid under pressure to one or more hydraulic working cylinders, each having a working piston therein, comprising:

a pneumatic first extensible fluid motor means having a first power transmitting means therein;

a solenoid operated air supply valve actuatable to a first position to place one side of said first power transmitting means in fluid communication with a pressurized source of air and the opposite side thereof in fluid communication with atmosphere, and to a second position to place said one side of said first power transmitting means if fluid communication with atmosphere and said opposite side in fluid communication with a pressurized source of air;

a hydraulic second slave extensible fluid motor means having a second power transmitting means therein, said second power transmitting means being operatively connected to and powered by said first power transmitting means;

first conduit means and second conduit means;

a first oil supply valve actuatable by said solenoid operated air supply valve to a first position when said air supply valve is in said first position to place one side of said second power transmitting means in fluid communication with a first conduit means and to place the opposite side thereof in fluid communication with a second conduit means, and to a second position to place said one side of said second power transmitting means in fluid communication with said second conduit means and to place said opposite side of said second power transmitting means in fluid communication with said first conduit means;

a pneumatically actuated oil control valve being connected via an advance oil conduit and a retract oil conduit to each said working cylinder and actuatable to a first position to place said first conduit means in fluid communication with said advance oil conduit and to place said second conduit means in fluid communication with said retract oil conduit and actuatable to a second position to place said first conduit means in fluid communication with said retract oil conduit and to place said second conduit means in fluid communication with said advance oil comduit;

a second solenoid operated air supply valve for actuating said oil control valve between its first and second positions;

a flow control check valve operably associated with said second conduit means, said check valve being closed when oil communication with said valve via said oil control valve is at a higher pressure than oil communicating with said valve via said oil supply valve;

oil bleed means operably associated with said second conduit means disposed on the opposite side of said check valve from said oil control valve; and intensifier means responsive to resistance in the movement of said working cylinders in either the advance or retract stroke thereof comprising, a hydraulic third slave extensible fluid motor means having third power transmitting means therein, and conduit means for communicating pressurized oil from said third fluid motor means to said second conduit means between said check valve and said oil control valve.

2. The hydraulic power unit of claim 1, wherein said hydraulic second slave extensible fluid motor means comprises hydraulic cylinder means including piston means.

3. The hydraulic power unit of claim 2, wherein said pneumatic first power extensible fluid motor means comprises a plurality of pneumatic cylinders and means for interconnecting the movement of said pneumatic cylinders.

4. The hydraulic power unit of claim 3, wherein said means for interconnecting includes means for powering said hydraulic second slave cylinder means.

5. The hydraulic power unit of claim 4, wherein said means for interconnecting includes means for powering said hydraulic third slave cylinder means.

6. The hydraulic power unit of claim 5, wherein said means for interconnecting comprises a plate extending between said pluraltiy of pneumatic cylinders and connected to said hydraulic second slave cylinder means.

7. The hydraulic power unit of claim 1, wherein said extensible fluid motor means operate in a reciprocating manner.

8. The hydraulic power unit of claim 7, further comprising an oil accumulator operable to feed pressurized oil to said working cylinders at the end of each direction of each stroke of reciprocation of said extensible fluid motor means.

9. The hydraulic power unit of claim 1, wherein said intensifier means and said hydraulic second slave fluid extensible motor means combine to supply fluid to said working cylinders at lower pressure and said intensifier means is capable of acting alone to supply fluid to intensify said working cylinders at a higher pressure.

10. The hydraulic power unit of claim 9, wherein said second power transmitting means moves within bore means in said second slave extensible fluid motor means and said third power transmitting means moves within bore means in said third hydraulic slave extensible fluid motor means, and said second motor means bore means has a cross-sectional area larger than said third motor means bore means.

11. The hydraulic power unit of claim 10, wherein said second motor means bore means cross-sectional area is more than four times as large as the cross-sectional area of said third motor means bore means.

12. An air operated demand only hydraulic power unit for supplying hydraulic fluid under pressure to one or more hydraulic working cylinders, each having a working piston therein, comprising:

a pneumatic first extensible fluid motor means having a first power transmitting means therein;

a first air supply valve actuatable to a first position to place one side of said first power transmitting means in fluid communication with a pressurized source of air and the opposite side thereof in fluid communication with atmosphere, and to a second position to place said one side of said first power transmitting means in fluid communication with atmosphere and said opposite side in fluid communication with a pressurized source of air;

a hydraulic second slave extensible fluid motor means having a second power transmitting means therein;

said second power transmitting means being operatively connected to and powered by said first power transmitting means;

first conduit means and second conduit means;

an oil supply valve actuatable by said first air supply valve to a first position when said first air supply valve is in said first position to place one side of said second power transmitting means in fluid communication with a first conduit means and to place the opposite side thereof in fluid communication with a second conduit means, and to a second position to place said one side of said second power transmitting means in fluid communication with said second conduit means and to place said opposite side of said second power transmitting means in fluid communication with said first conduit means;

an oil control valve being connected via an advance oil conduit and a retract oil conduit to each said working cylinder and actuatable to a first position to place said first conduit means in fluid communication with said advance oil conduit and to place said second conduit means in fluid communication with said retract oil conduit and actuatable to a second position to place said first conduit means in fluid communication with said retract oil conduit and to place said second conduit means in fluid communication with said advance oil conduit;

a second air supply valve for actuating said oil control valve between its first and second positions;

a flow control check valve operably associated with said second conduit means, said check valve being closed when oil communicating with said valve via said oil control valve is at a higher pressure than oil communicating with said valve via said oil supply valve;

oil bleed means operably associated with said second conduit means disposed on the opposite side of said check valve from said oil control valve; and intensifier means responsive to resistance in the movement of said working cylinders in either the advance or retract stroke thereof.

13. The hydraulic power unit of claim 12, wherein said first pneumatic power extensible fluid motor means comprises pneumatic cylinder means.

14. The hydraulic power unit of claim 12, wherein said second hydraulic slave extensible fluid motor means comprises hydraulic cylinder means.

15. The hydraulic power unit of claim 12, wherein said first and second fluid motor means each ahve a reciprocable stroke and said unit is capable of advancing or retracting said working pistons on demand at any position or direction of the reciprocable strokes of said first and second fluid motor means.

* * * * *

UNITED STATES PATENT AND TRADEMARK OFFICE

CERTIFICATE OF CORRECTION

PATENT NO. : 4,455,828

DATED : June 26, 1984

INVENTOR(S) : Joseph D. Snitgen

It is certified that error appears in the above-identified patent and that said Letters Patent is hereby corrected as shown below:

Column 1, line 29, "or" should be -- of --.

Column 2, line 20, "Addtional" should be -- Addtional --.

Column 3, line 63, after "presurized" should be --
-- pressurized --.

Column 4, line 32, "communicate" should be
-- communicates --.

Column 5, line 8, "vavle" should be -- valve --.

Column 5, line 8, "mpounted" should be -- mounted --.

Column 5, line 48, "104(via" should be -- 104 (via --.

UNITED STATES PATENT AND TRADEMARK OFFICE

CERTIFICATE OF CORRECTION

PATENT NO. : 4,455,828

DATED : June 26, 1984

INVENTOR(S) : Joseph D. Snitgen

It is certified that error appears in the above-identified patent and that said Letters Patent is hereby corrected as shown below:

Column 5, line 52, "againt" should be -- against --.

Column 6, line 22, "late" should be -- plate --.

Column 6, lines 35 & 36, "disslosed" should be --
-- disclosed --.

Column 8, line 34, Claim 1, "comduit" should be -- conduit --.

Column 10, line 49, Claim 15, "ahve" should be -- have --.

Signed and Sealed this

Twentieth Day of November 1984

[SEAL]

Attest:

GERALD J. MOSSINGHOFF

Attesting Officer

Commissioner of Patents and Trademarks